US005281191A

United States Patent [19]

DeSousa

[11] Patent Number: 5,281,191

[45] Date of Patent: Jan. 25, 1994

[54] STRIKING DUMMY AS PUNCHING BAG ATTACHMENT

[76] Inventor: Daniel A. DeSousa, 43 Nottingham Pl., Clayton, Calif. 94517

[21] Appl. No.: 15,480

[22] Filed: Feb. 8, 1993

[51] Int. Cl.[5] ..... A63B 69/34

[52] U.S. Cl. ..... 482/83; 482/87; 273/55 A

[58] Field of Search ..... 482/33, 55 R, 83-85, 482/55 A, 55 R, 86-90

[56] References Cited

U.S. PATENT DOCUMENTS

| | | | |
|---|---|---|---|
| 168,302 | 12/1952 | Holt | 273/55 A |
| 2,909,370 | 10/1959 | Fortney . | |
| 2,929,629 | 3/1960 | Feula | 482/83 |
| 3,218,070 | 11/1965 | Crowther | 273/55 R |
| 3,250,533 | 5/1966 | Nicholson, II . | |
| 3,396,969 | 8/1968 | Rosenfeld | 273/55 R |
| 3,521,882 | 7/1970 | Kiernan | 482/86 |
| 3,700,237 | 10/1972 | Kopp | 273/55 A |
| 3,804,406 | 4/1974 | Viscione . | |
| 4,088,315 | 5/1978 | Schemmel . | |
| 4,572,504 | 2/1986 | Dibartolo | 482/83 |
| 4,702,472 | 10/1987 | Anquelil | 482/33 |
| 5,183,450 | 2/1993 | Stelmack | 482/83 |

FOREIGN PATENT DOCUMENTS

| | | | |
|---|---|---|---|
| 0173129 | 3/1986 | European Pat. Off. | 482/83 |

OTHER PUBLICATIONS

Football Magic Man, Marty Gilmans "Go-back" Jan. 4, 1937.

*Primary Examiner*—Stephen R. Crow
*Assistant Examiner*—Jerome Donnolly

[57] ABSTRACT

A life-like striking dummy as an attachment to a punching bag for use in boxing, martial arts, and the like, is disclosed. More specifically its purpose is to augment and improve realism of training utilizing a punching bag as a mounting device. The striking dummy is sculptured three-dimensionally and comprises a first portion configured to anatomically resemble a human head, and is connected by a neck to a second portion configured to anatomically resemble a human torso. The total embodiment is detailed with facial, muscular, and skeletal features as targets to be struck by the user. The head, neck, and torso are homogeneously connected by construction preferably utilizing an integral skin flexible polyurethane foam material. The integral skin of the polyurethane is a near solid resilient protective outer layer which serves to prevent injury or damage to the striking dummy or user. The cellular foam core is homogeneously distributed throughout the entire inner structure of the embodiment and is human-like in density, providing a realistic feel of striking an opponent. The striking dummy is configured with mounting straps for the purpose of attachment to a punching bag. The striking dummy may be configured with a radiused vertically positioned recess at the back, to allow a contoured mating surface to a punching bag.

7 Claims, 2 Drawing Sheets

STRIKING DUMMY AS PUNCHING BAG ATTACHMENT

BACKGROUND

1. Field of Invention

This invention relates to boxing and martial arts striking bags, and more specifically to a life-like striking dummy as an attachment to a punching bag.

2. Description of the Prior Art

Punching bags and dummies have been the primary apparatuses for training in the art of boxing, martial arts, and the like. The punching bag and dummy serves as a substitute for an opponent in practice.

The lack of realism in detail of the present art is evident by sighting that most bags are simply a canvas cylindrical form with some sort of filling to simulate an opponents shape and body weight. Additional attempts to create realistic practice dummies have been complicated and expensive to manufacture. For examples, see U.S. Pat. Nos. 2,909,370; 3,250,533; 3,804,406; and 4,088,315.

The construction of these dummies is comprised of a combination of gears, shafts, casters, springs, and movement promoted by impact, pneumatics, and electrically driven devices. The pneumatic and electrical devices require sophisticated circuitry to program and actuate the limbs. The constant flailing movement and striking arms of the dummy may be dangerous to the user if struck by a blow. In addition, as in any mechanical, pneumatic, or electrical device, subsequent wear and failure are prone to occur.

SUMMARY OF THE INVENTION

The object of this invention is to provide a simple, improved, and realistic means of practice and conditioning by augmenting and utilizing the existing primary apparatus of the gym the punching bag. Another object of this invention is to improve the accuracy of strikes on the apparatus by offering specific targets such as head, nose, chin, shoulders, chest, ribs, and abdomen. It is also the object of this invention to make training in the art a more enjoyable task by way of an anatomically sculptured torso as a target.

The striking dummy is preferably a single molded embodiment of an integral skin flexible polyurethane foam. One suitable foam of this type is manufactured by Burtin Corporation of Santa Ana, Calif. The key advantage of this material is its characteristic of expanding and filling a cavity in which it is dispensed. This cavity is the tool to produce a part. As the material expands, a near solid resilient skin is formed against the tool wall encapsulating the closed cellular interior structure of the embodiment. This process and material can be formulated to produce extremely accurate detail and human-like density.

Accordingly, in addition to the objects and advantages of my invention stated above, additional advantages of the invention are:

(a) a simple attachment device that does not drastically alter the training method of the present art.

(b) a training device that allows the user to apply a combination of punches to a human-like target.

(c) a training device that allows the user to rest his chin on the shoulders of the device to simulate tying up the opponent.

(d) a training device that allows the user to adjust the height to adapt to different height opponents.

(e) a training device that comprises a visible belted waist to recognize and minimize low blows.

(f) a training device with human-like density.

Further improvements and benefits derived from this invention will become apparent from the drawings and ensuing description.

BRIEF DESCRIPTION OF THE DRAWINGS

The forementioned features of the invention will become more clearly understood from the following description read together with the accompanying drawings in which.

Reference Numerals of Drawings

Figure 1:
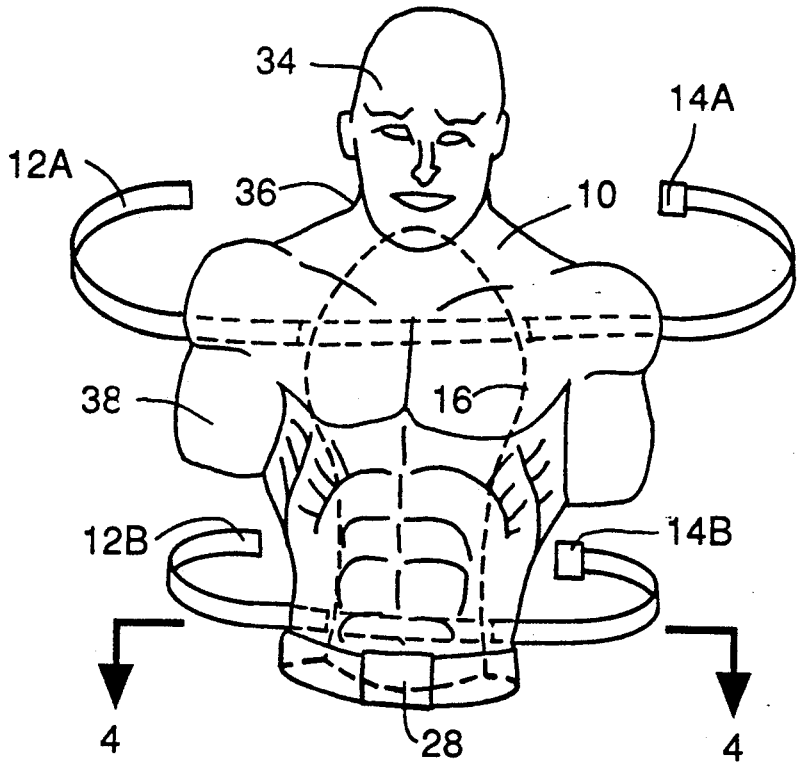
FIG. 1 is a frontal view of the attachment apparatus.

10 body of striking dummy
12A–B attachment straps
14A–B buckles
16 contoured/concave recess
18 integral skin
20 cellular foam core
22 embedded straps
24 punching bag
26 vertical longitudinal centerline
28 belted waist
30 centerline axis of bottom plane
32 base of skull
34 head
36 neck
38 torso
40 neck reflex angle

DETAILED DESCRIPTION OF INVENTION

A sculptured three dimensional life-like striking dummy 10 is disclosed in FIG. 1. Striking dummy 10 comprises a first portion head 34, having human facial details defining eyebrows, eyes, ears, nose, lips, jaws, and chin. The second portion, a torso 38 of striking dummy 10 is connected by a neck 36 to first portion head 34. Torso 38 is human-like in details comprising shoulders, biceps, chest, ribs, abdomen, and belted waist 28. Belted waist 28 represents the lowest area allowed to be struck fairly in boxing. Attachment straps 12A and 12B are positioned and embedded horizontally on back of striking dummy 10 and exit on both sides immediately exterior of the contoured/concave recess 16 at levels approximate to midchest and abdomen. Attachment straps 12A and 12B are affixed with buckles 14A and 14B at one end. Attachment straps 12A and 12B are wrapped circumferentially around punching bag 24 as disclosed in FIG. 2, and are joined to buckles 14A and 14B. Straps 12A and 12B are pulled taunt and secure striking dummy 10 to punching bag 24.

Figure 2:
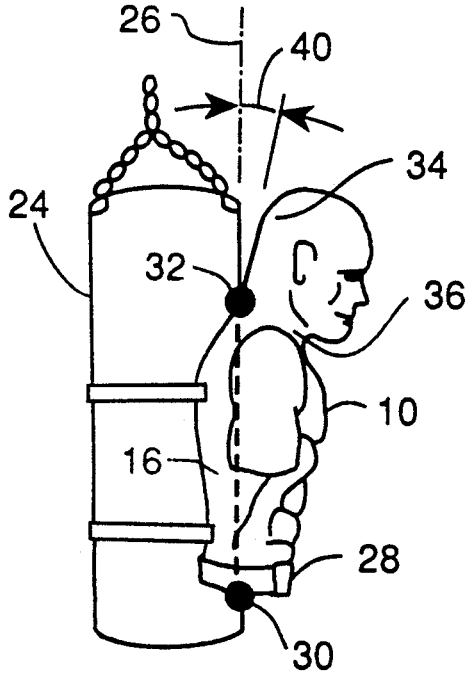
FIG. 2 is a side view of the attachment apparatus.

FIG. 2 is a side view of striking dummy 10 showing a vertical longitudinal centerline 26 of a concave recess 16 extending longitudinally therethrough for receiving and nesting punching bag 24. Vertical longitudinal centerline 26 is originated at the base of skull 32 to a centerline axis of bottom plane 30 of striking dummy 10. Vertical longitudinal centerline 26 emerges upwardly from base of skull 32 and creates an acute angle generally ranging from 15 to 20 degrees relative to the rear of head the 34. This acute angle creates neck reflex angle 40 providing reflex movement from upward strikes applied to chin of head 34.

Figure 3:
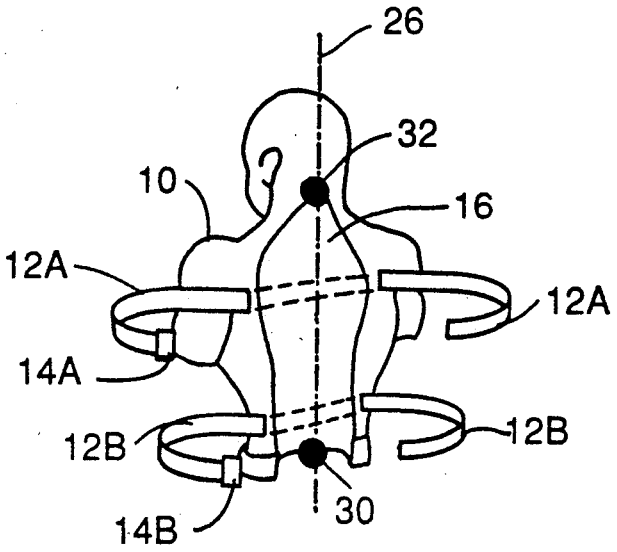
FIG. 3 is a perspective back view of the attachment apparatus showing mounting straps and preferred contoured/concave recess.

FIG. 3 is a back view of striking dummy 10 disclosing straps 12A and 12B. Straps 12A and 12B are affixed with buckles 14A and 14B at each end. Also disclosed is concave recess 16 with vertical longitudinal centerline 26 extending from base of skull 32 to centerline axis of bottom plane 30.

Figure 4:
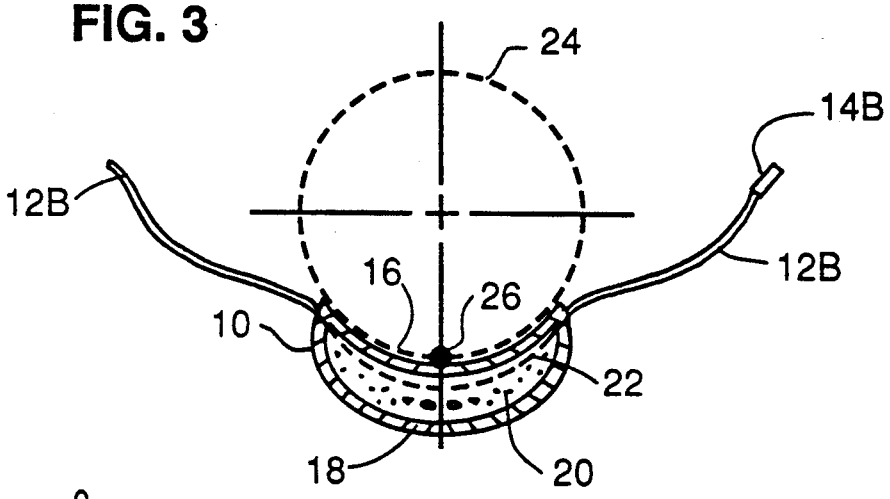
FIG. 4 is a sectional view of the preferred typical construction and method of strap retention of the attachment apparatus.

FIG. 4 is a sectional view of striking dummy 10 through the midsection of attachment strap 12B. The typical construction of striking dummy 10 is disclosed as having an outer structure of a near solid resilient skin 18 which encapsulates a cellular foam core 20 of human-like density. Attachment strap 12B is shown as an embedded attachment in cellular foam core 20 and exiting from both sides immediately exterior of concave recess 16. Attachment strap 12A is similarly embedded. Concave recess 16 is radially shaped throughout its longitudinal length and sized to receive and nest punching bag 24. Most punching bags are approximately 14 inches in diameter.

Figure 5:
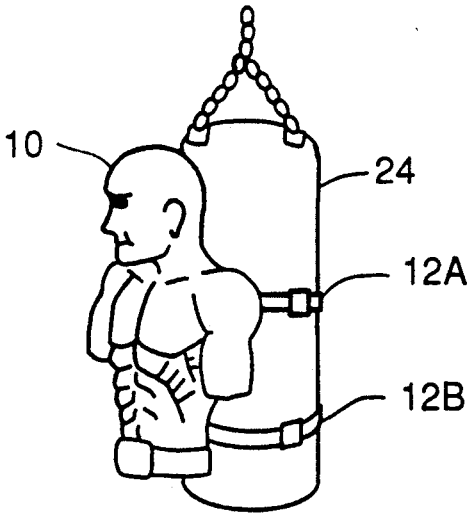
FIG. 5 is a perspective view of the attachment apparatus secured to a punching bag.

FIG. 5 is a perspective view of striking dummy 10 secured by straps 12A and 12B to vertically positioned punching bag 24.

While the preferred embodiment is disclosed, it will be understood that there is no intent to limit the invention to such disclosure, but rather it is intended to cover all modifications and alternate materials and methods of construction falling within the field of this invention. For example, the body 10 could be fabricated from a sewn durable closely woven heavy fabric and filled with a suitable material to provide shape, density, and weight, rather than the preferred urethane material previously described. Accordingly, the disclosure of the present invention is intended to be illustrative, but not limiting, of the scope of the invention setforth in the following claims.

What is claimed is:

1. A life-like striking dummy configured to be attachable to a pouching bag, for use in the practice of boxing, martial arts and the like comprising; a body, wherein said body comprises a first portion and a second portion connected together by a neck portion, said first portion being configured to resemble a human head; said first portion having a rear section and a frontal area, said frontal area including facial features, said second portion configured to resemble a human torso and having a back with a vertically positioned contoured recess, for the purposes of providing a contoured mating surface to a punching bag; said contoured recess originating from a centerpoint at a rear most base of said first portion and terminating at a centerline axis at a bottom plane of said torso; said contoured recess being longitudinally aligned with a vertical longitudinal centerline; said vertical longitudinal centerline when extended upward beyond said rear most base of said first portion creating an acute angle to the rear of said neck; said acute angle being formed between said extended vertical, longitudinal centerline and said rear of said neck creating a neck reflex angle; said neck reflex angle being provided for the purpose of allowing reflex movement of said head, in a rearward direction a distance, before the rear of said head intersects said vertical longitudinal centerline, when struck by a user; and said second portion configured with means of securing said striking dummy to said punching bag.

2. The device of claim 3 wherein said body is comprised of: a flexible integral skin polyurethane foam body having a near solid resilient encapsulated outer layer and an inner closed-cellular structure.

3. The device of claim 1 wherein said contoured recess is concave in shape.

4. The device of claim 1 wherein said facial features are selected from a group consisting of eyebrows, eyes, ears, nose, lips, jaw, and a chin.

5. The device of claim 1 wherein said second portion includes features from a group consisting of shoulders, biceps, a chest area, ribs, an abdomen, and a belted waist.

6. The device of claim 5 wherein said means of securing said striking dummy to said punching bag includes embedded mounting straps positioned horizontally at levels approximate to said chest and abdomen of said torso of said second portion; said straps exiting at the back of said torso immediately adjacent said contoured recess; configured for the purpose of wrapping circumferentially about; engaging and fastening around said punching bag.

7. The device of claim 6 wherein said straps include buckle fastening means.

* * * * *